US007867453B2

(12) United States Patent
Wu et al.

(10) Patent No.: US 7,867,453 B2
(45) Date of Patent: Jan. 11, 2011

(54) GRAVITY-DRIVEN FRACTION SEPARATOR AND METHOD THEREOF

(75) Inventors: Jhy-Wen Wu, Hsinchu (TW); Hung-Jen Yang, Hsinchu (TW); Nan-Kuang Yao, Taoyuan County (TW)

(73) Assignee: Industrial Technology Research Institute, Hsinchu (TW)

( * ) Notice: Subject to any disclaimer, the term of this patent is extended or adjusted under 35 U.S.C. 154(b) by 1147 days.

(21) Appl. No.: 11/524,372

(22) Filed: Sep. 21, 2006

(65) Prior Publication Data

US 2007/0297949 A1 Dec. 27, 2007

(30) Foreign Application Priority Data

Jun. 23, 2006 (TW) ..... 95122617 A

(51) Int. Cl.
*B01L 3/00* (2006.01)

(52) U.S. Cl. ..... 422/102; 422/100; 422/101; 422/103

(58) Field of Classification Search ..... 422/101, 422/102, 100, 103; 436/180
See application file for complete search history.

(56) References Cited

U.S. PATENT DOCUMENTS

2004/0096358 A1 * 5/2004 Blankenstein et al. ..... 422/58

* cited by examiner

*Primary Examiner*—Natalia Levkovich
(74) *Attorney, Agent, or Firm*—Birch, Stewart, Kolasch & Birch, LLP

(57) ABSTRACT

The present invention relates to a gravity-driven fraction separator and method thereof. The gravity-driven fraction separator is substantially a substrate having a microchannel structure arranged thereon, in which the microchannel structure is extending longitudinally on the substrate while sloping with respect to the level of the substrate by a specific angle. As a micro fluidics is being filled in a loading well situated upstream of the microchannel structure, the micro fluidics is driven by gravity to flow downstream in the microchannel structure while filling a plurality of manifolds formed in a area situated downstream of the microchannel structure, so that accurate quantification and separation of the micro fluidics using the plural manifolds, each having a specific length, can be achieved and provided for posterior inspection and analysis.

14 Claims, 5 Drawing Sheets

GRAVITY-DRIVEN FRACTION SEPARATOR AND METHOD THEREOF

FIELD OF THE INVENTION

The present invention relates to a gravity-driven separator and method, and more particularly, to a microchannel mechanism without movable valves that is capable of utilizing the geometric structure of the microchannel mechanism for enabling a micro fluidics to be driven to flow by a suction and gravity, and thus an accurate and automatic quantification/separation of the micro fluidics can be achieved. In addition, the process for fabricating the aforesaid separator is relatively simply and can be adapted for all kinds of micro flow system applicable for any micro fluidics operations, such as cell culturing, pharmaceutical inspecting or bio-chemical inspecting, and so on.

BACKGROUND OF THE INVENTION

As silicon microelectronics have made computation ever faster, cheaper, more accessible and more powerful, the development of microfluidic chips, which are feats of miniscule plumbing where more than a hundred cell cultures or other experiments can take place in a rubbery silicone integrated circuit the size of a quarter, could bring a similar revolution of automation to biological and medical research. Right now biological automation is in its infancy, that it's all about using large robots to push fluids around in the same way that computers in the early days were about big mainframes. It's expensive, bulky, and inflexible. The expense, inefficiency and high maintenance and space requirements of robotic automation systems present barriers to performing experiments. By contrast, microfluidic chips are inexpensive, stable and require little maintenance or space. They also need very small amounts of samples and chemical inputs to make experiments work, making them more efficient, less power consuming, and potentially cheaper to use. However, it is difficult to enable a specimen to be separate into a plurality of samples automatically and accurately for performing various tests thereupon in a microfluidic chip, since the physical attributes of the specimen are not quite the same in the micro world. It is noted that, at the human scale, surface tension is a force of little relevance compared to the force of gravity, however, in a miniaturized scale, the significance of gravity is reduced and the surface tension is a force to reckon with, moreover, not only the cohesion force of the micro fluidics is becoming significant, but also the influence of particle infiltration upon surface in contact with the micro fluidics should not be overlooked any more.

Hence, it is not a simple task to automate the quantification and separation of a specimen in a microfluidic chip. Please refer to FIG. 1, which shows the pressures required to be overcome for enabling a micro fluidics to flow through a microchannel of reducing diameters, illustrated in "Utilization of surface tension and wettability in the design and operation of microsensors", Sensors and Actuators B71 (2000) 60-67, by P. G. Wapner, et al. In 2000, Wapner had disclosed that the flowing of a fluid in a microchannel is no longer significantly influenced by gravity, however, other parameters, such as surface tension, are becoming more significant with the decreasing of the diameter of the microchannel. As seen in FIG. 1, the flow resistance is increase with respect to the decrease of the diameter, so that the design of the microchannel must be changed accordingly.

Please refer to FIG. 2, which is a miniaturized microfluidic system disclosed in "Micromachined thermoelectrically driven cantilever structures for fluid jet system", Proc. IEEE Micro Electro Mechanical System Workshop, MEMS'92, 1992, by C. Doring et al. The miniaturized microfluidic system shown in FIG. 2 is characterized in that: the flowing direction of a micro fluidics can be controlled by electrical signals and thus the controlling is facilitated by the operation of certain active devices such as micro valves. However, the aforesaid system is disadvantageous in that the active valves are additional and required for the operation of the microfluidic system.

Please refer to FIG. 3 and FIG. 4, which are diagrams illustrating a method for controlling the flowing direction of a micro fluidics, disclosed in J. Micromechanics and Microengineering, 11, 567, 2001 and 11, 654, 2001, by G. B. Lee et al. The aforesaid method is characterized in that the flowing direction of the micro fluidics can be controlled without the help of any valve device. However, the aforesaid method is disadvantageous in that the control of the flowing direction is driven by voltage.

Please refer to FIG. 5, which is a biomedical test disc disclosed by Marc J. Madou et al. The biomedical test disc of FIG. 5 is substantially a plastic disc having a plurality of microchannels formed thereon by a means of electroplating and press-molding, whereas the flowing of a micro fluidics is driven by the centrifugal force induced by a rotation platform carrying the test disc with respect to the cooperation of five passive valves fabricated in the microchannels. In addition, microfluidic devices, such as micromixers, are formed on the biomedical test disc. However, the aforesaid biomedical test disc is disadvantageous in that not only the structure of the test disc is complicated, but also additional valves are required for the operation of the biomedical test disc.

Please refer to FIG. 6, which is a disposable surface tension driven microfluidic biomedical test chip disclosed by F. G. Tseng et al. The biomedical test chip of FIG. 6 is substantially a substrate having a layer of SU-8 disposed thereon while forming microchannel in the SU-8 layer; wherein the microchannel is formed into a H-shaped structure with a hydrophilic inner wall made of a ploydimethylsilozane (PDMA) material. By the H-shaped microchannel, samples can be dispense to different sensors by the driven of surface tension. However, the aforesaid biomedical test chip is disadvantageous in that it is required to be processed by a plasma process for enabling the microchannel to have a hydrophilic inner wall.

Please refer to FIG. 7, which is schematic diagram showing the operation of an autonomous microfluidic capillary system disclosed by B. Michel. The autonomous microfluidic capillary system is adapted to be applied by an immunoassay chip, that it is substantially a formation of a plurality of microchannels of different aspect ratio while integrating the microchannel formation with micro devices, such as micro pump and micro valve, etc., so as to enable a micro fluidics to be separated and flow into each microchannels independent to each other and correspondent to the pressure and resistance exerted thereon by the structure of the corresponding microchannel. However, the aforesaid autonomous microfluidic capillary system is disadvantageous in that the structure of the corresponding immunoassay chip is complicated With respect to the abovementioned prior-art disadvantages, the fabrication of microfluidic chip is complicated and costly. Therefore, it is in need of a low-cost, simple-structured and easy-to-implement platform or apparatus that is capable of enforcing an accurate and automatic quantification/separation operation upon a specimen.

SUMMARY OF THE INVENTION

In view of the disadvantages of prior art, the primary object of the present invention is to provide a gravity-driven fraction separator without movable valves that is capable of utilizing the geometric structure of the microchannel mechanism for enabling a micro fluidics to be driven to flow by a suction caused by gravity, and thus an accurate and automatic quantification/separation of the micro fluidics can be achieved. In addition, the process for fabricating the aforesaid separator is relatively simply and can be adapted for all kinds of micro flow system applicable for any micro fluidics operations, such as cell culturing, pharmaceutical inspecting or biochemical inspecting, and so on.

To achieve the above object, the present invention provides a gravity-driven fraction separator for accomplishing an accurate and automatic quantification/separation of a micro fluidics, comprising:

a substrate; and a microchannel structure, extending longitudinally on the substrate while sloping with respect to the level of the substrate by a specific angle.

Preferably, the microchannel structure further comprises:

at least a main channel, extending while sloping with respect to the level of the substrate by the specific angle; and a plurality of manifolds, formed in a area situated downstream of each main channel while each being connected to the main channel corresponding thereto.

Preferably, the depth of each main channel is different from that of each manifold connecting thereto.

Preferably, the depth of each main channel is larger than that of each manifold connecting thereto.

Preferably, at least a pit is formed on each main channel at each interval between any two neighboring manifolds connecting to the main channel.

Preferably, the plural manifolds are formed parallel to each other.

Preferably, the lengths of the plural manifolds are different from each other.

In a preferred aspect, the gravity-driven fraction separator further comprises:

at least a loading well, each situated upstream of a main channel corresponding thereto, for receiving the micro fluidics and enabling micro fluidics to fill into the corresponding main channel; and a plurality of reservoirs, disposed respectively at the ends of the plural manifolds, for receiving the micro fluidics.

Preferably, the loading well is channel to an opening for enabling a specific pressure to be exerted upon the micro fluidics received in the loading well therethrough.

Preferably, the cross-section area of each reservoir is different from that of the manifold connecting thereto.

Preferably, each of the plural reservoirs is channel to a piping capable of generating a suction force.

Preferably, each main channel further comprises a waste well, situated downstream and at the end of the same.

Preferably, the cross-section area of each waste well is different from that of the main channel connecting thereto.

Preferably, an absorbent material is disposed in each waste well.

Preferably, the absorbent material is a material selected from the group consisting of a super absorbent fiber, other hydrophilic materials and the combination thereof.

Preferably, each main channel further comprises:

a first duct, extending longitudinally on the substrate while sloping with respect to the level of the substrate by the specific angle; and a second duct, connecting to the first duct while extending transversely with respect to the substrate;

wherein, the plural manifolds are connected to the second duct while each extending longitudinally on the substrate in a manner similar to that of the first duct.

Preferably, the diameter of the cross-section area of the microchannel structure is between 0.1 micrometer and 1000 micrometers.

Preferably, the microchannel structure is formed by milling the substrate.

Preferably, the interior of the microchannel structure is processed by a hydrophilic/hydrophobic coating.

Preferably, the substrate is made of Polymethyl Methacrylate (PMMA).

Preferably, the substrate is sloping wile extending longitudinally with respect to the datum water level for enabling the microchannel structure formed thereon to slope respect to the datum water level by a specific angle while extending longitudinally on the substrate.

Moreover, to achieve the above object, the present invention provides a gravity-driven fraction method for accomplishing an accurate and automatic quantification/separation of a micro fluidics, comprising steps of:

(a) filling a micro fluids into the upstream of a microchannel structure, whereas the microchannel structure is extending while sloping with respect to a level by a specific angle;

(b) enabling the micro fluidics to flow toward the downstream of the microchannel structure as it is driven by gravity; and (c) enabling the micro fluidics to fill a plurality of manifolds, whereas each manifold is formed at the downstream of the microchannel structure and each has a specific length.

Other aspects and advantages of the present invention will become apparent from the following detailed description, taken in conjunction with the accompanying drawings, illustrating by way of example the principles of the present invention.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the follows.

The intension of the present invention is to utilize the physical attributes of a micro-scale micro fluidics for achieving an accurate and automatic quantification/separation of the micro fluidics. In the present invention, gravity is specified as the force used for driving the micro fluidics to flow. As the micro fluidics is driven to flow in a microchannel by gravity, surface tension effect is becoming significant as the change of liquid-gas-solid interface free energy, such that the moving direction of the micro fluidics can be controlled by the structure design of the microchannel or the texture of the microchannel. Hence, as surface tension effect can be adopted for controlling the flowing of a micro fluidics, not additional movable part is required. The theorem of the aforesaid control method is described hereinafter.

In a microfluidic system as a micro fluidics is flowing in a microchannel, the total interfacial energy $U_T$ of the system is $$U_T = A_{SL}\gamma_{SL} + A_{SG}\gamma_{SG} + A_{LG}\gamma_{LG} \tag{1}$$

wherein $A_{SL}$ represents solid-liquid interface area;

$A_{SG}$ represents solid-gas interface area;

$A_{LG}$ represents liquid-gas interface area;

$\gamma_{SL}$ represents solid-liquid surface tension;

$\gamma_{SG}$ represents solid-gas surface tension;

$\gamma_{LG}$ represents liquid-gas surface tension.

When a liquid is placed in contact with a solid surface, a contact angle $\theta_C$ is formed by the solid/liquid interface and is referred as a liquid-solid contact angle. Hence, the surface tension forces per unit length are related to equilibrium contact angle $\theta_C$ by Young's equation, that is, $$\gamma_{SG} = \gamma_{SL} + \gamma_{LG}\cos\theta_C \tag{2}$$

The effective pressure P applied on the fluid column can be deducted from the derivative of the total interfacial energy $U_T$ of the system with respect to a liquid volume $V_L$, that is, $$P = \frac{dU_T}{dV_L} = \gamma_{LG}\left(\cos\theta_C \frac{dA_{SL}}{dV_L} - \frac{dA_{LG}}{dV_L}\right) \tag{3}$$

By the aforesaid formula (3), the pressure driving the micro fluidics is related to the variation of the total interfacial energy $U_T$ and the liquid volume $V_L$. Thus, it is concluded that a passive valve can be achieved by the control of the total interfacial energy $U_T$ or the liquid volume $V_L$ according to the aforesaid formula (3).

Figure 1:
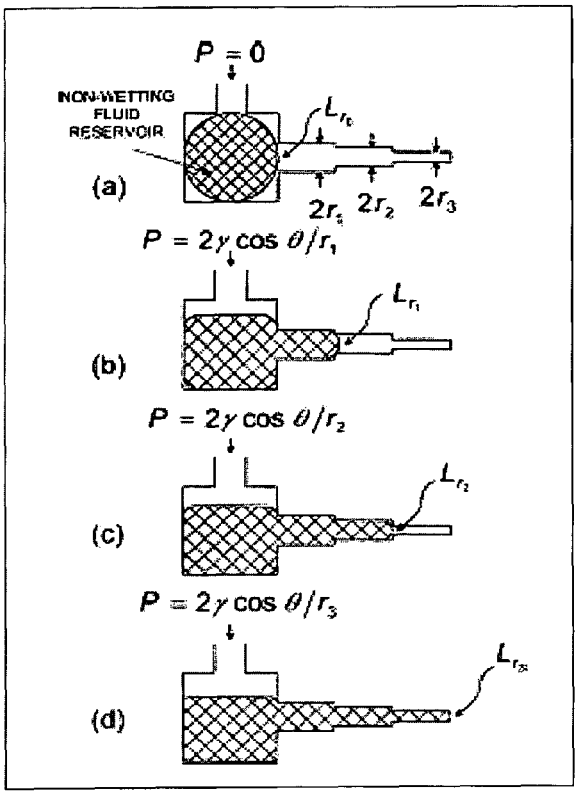
FIG. 1 (PRIOR ART)
FIG. 1 shows the pressures required to be overcome for enabling a micro fluidics to flow through a microchannel of reducing diameters, illustrated in "Utilization of surface tension and wettability in the design and operation of microsensors", Sensors and Actuators B71 (2000) 60-67, by P. G. Wapner, et al.
Figure 2:
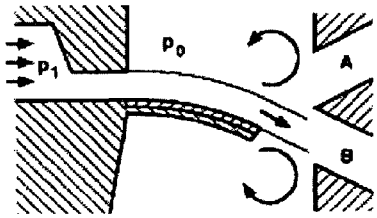
FIG. 2 (PRIOR ART)
FIG. 2 is a miniaturized microfluidic system disclosed in "Micromachined thermoelectrically driven cantilever structures for fluid jet system", Proc. IEEE Micro Electro Mechanical System Workshop, MEMS'92, 1992, by C. Doring et al.
Figure 3:
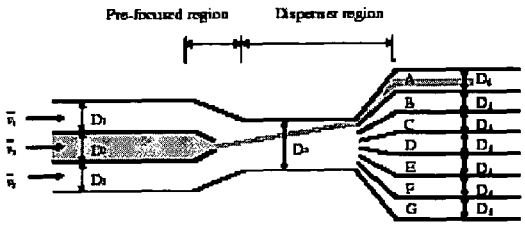
FIG. 3 (PRIOR ART)
FIG. 3 is a diagrams illustrating a method for controlling the flowing direction of a micro fluidics, disclosed in "Micromachined pre-focused 1×N flow switches for continuous sample injection", J. Micromechanics and Microengineering, 11, 567, 2001 by G. B. Lee et al.
Figure 4:
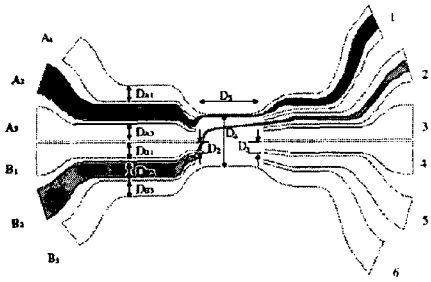
FIG. 4 (PRIOR ART)
FIG. 4 diagrams illustrating a method for controlling the flowing direction of a micro fluidics, disclosed in "Micromachined pre-focused M×N flow switches for continuous sample injection", J. Micromechanics and Microengineering, 11, 654, 2001, by G. B. Lee et al.
Figure 5:
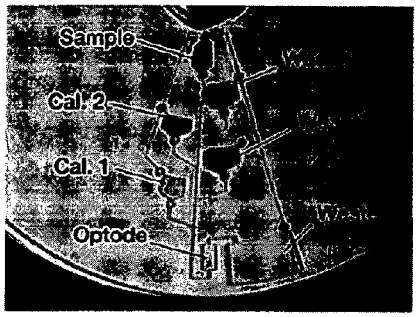
FIG. 5 (PRIOR ART)
FIG. 5 is a prior-art biomedical test disc disclosed by Marc J. Madou et al.
Figure 6:
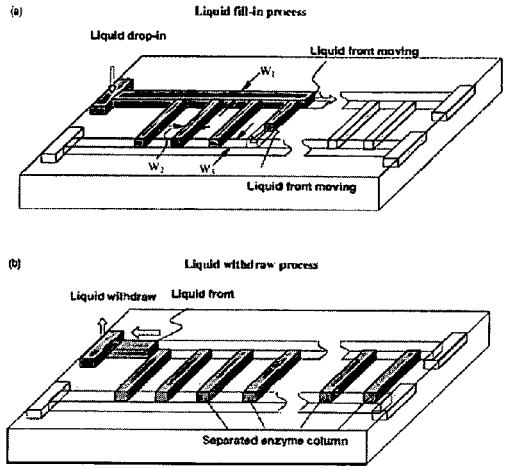
FIG. 6 (PRIOR ART)
FIG. 6 is a prior-art disposable surface tension driven microfluidic biomedical test chip disclosed by F. G. Tseng et al.
Figure 7:
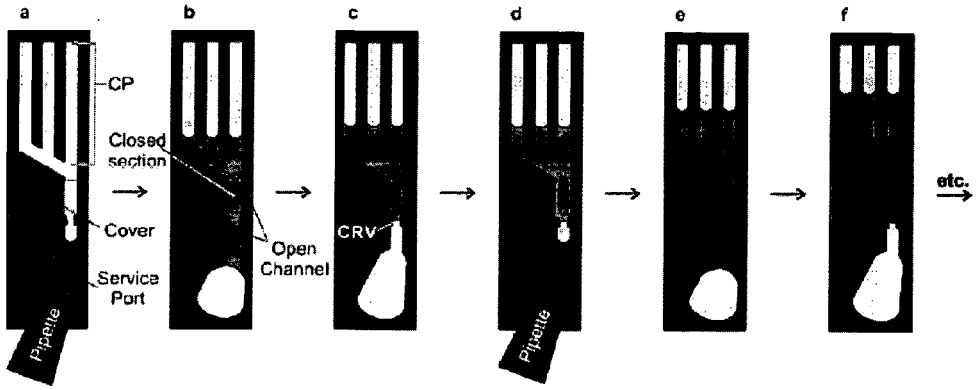
FIG. 7 (PRIOR ART)
FIG. 7 is schematic diagram showing the operation of a prior-art autonomous microfluidic capillary system disclosed by B. Michel.
Figure 8:
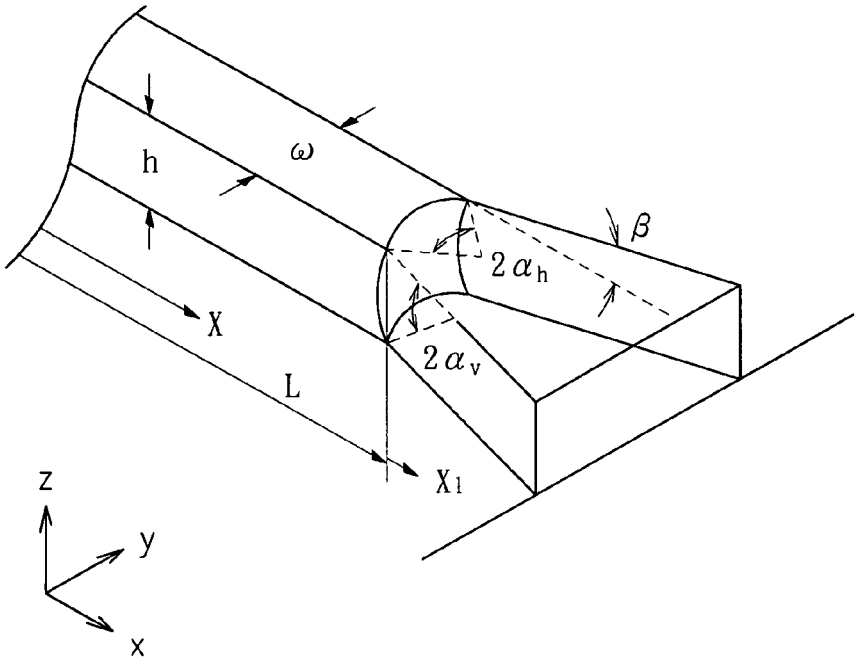
FIG. 8 is a perspective view of a microchannel with micro fluidics flowing therein.

However, the above description is only fitted to two-dimensional analysis. But in three-dimensional meniscus analysis, meniscus shape is assumed to be two circular arcs of angles, in both horizontal and vertical directions, as shown in FIG. 8. Therefore, the total interfacial energy $U_T$ becomes $$U_T = U_0 - \gamma_{La}\cos\theta_C\left[2L(w+h) - \frac{w^2}{2\sin\alpha_h}\left(\frac{\alpha_h}{\sin\alpha_h} - \cos\alpha_h\right)\right] + \gamma_{La}\frac{wh\alpha_h\alpha_v}{\sin\alpha_h\sin\alpha_v} \tag{4}$$

the liquid volume $V_L$ is $$V_L = wlh\frac{w^2h}{4\sin\alpha_h}\left(\frac{\alpha_h}{\sin\alpha_h}h - \cos\alpha_h\right) - \frac{wh^2\alpha_h}{4\sin\alpha_v\sin\alpha_h}\left(\frac{\alpha_v}{\sin\alpha_v} - \cos\alpha_v\right) \tag{5}$$

Thus, it can be seen from formula (4) and formula (5), the design parameter of a passive valve includes:

(1) microchannel height h;

(2) microchannel width w; and (3) expansion angle β.

From the above description, a microchannel mechanism without movable valves that is capable of utilizing surface tension effect of the microchannel along with a suction between micro fluidics and gravity can be accomplished, that is, a system capable of achieving an accurate and automatic quantification/separation of the micro fluidics.

Figure 9B:
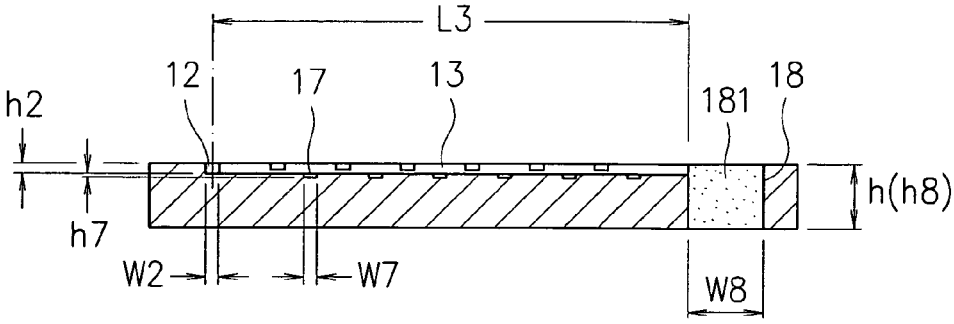
FIG. 9B is the B-B cross-section of FIG. 9.
Figure 9A:
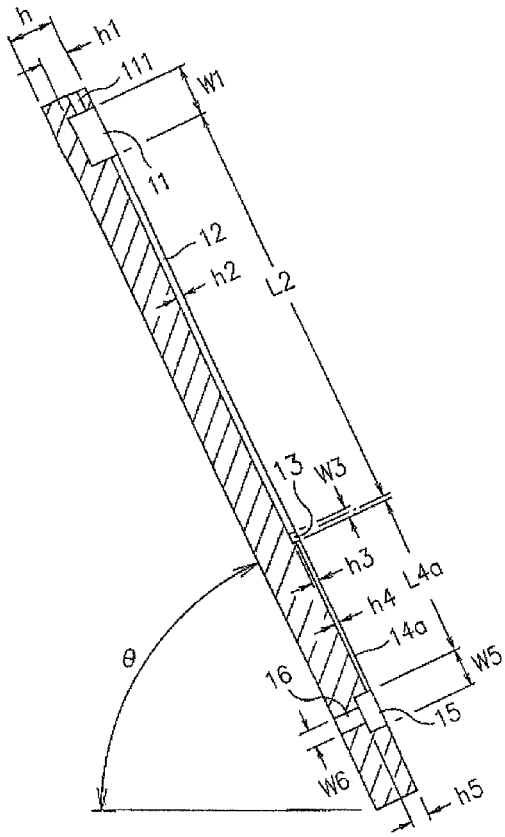
FIG. 9A is the A-A cross-section of FIG. 9.
Figure 9:
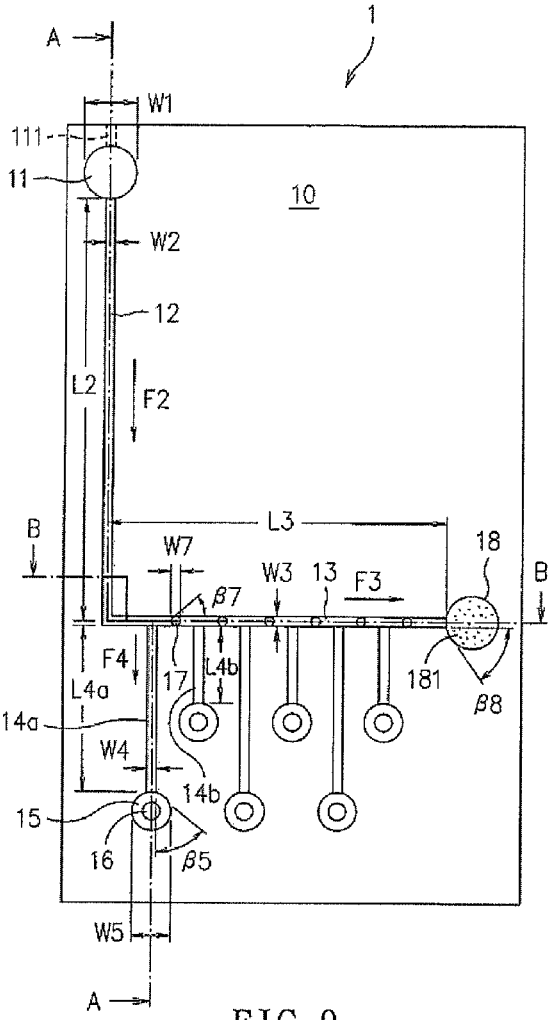
FIG. 9 is a top view of a gravity-driven fraction separator according to a preferred embodiment of the invention.

Please refer to FIG. 9, FIG. 9A and FIG. 9B, which are respectively a top view, an A-A cross-sectional view and a B-B cross-sectional view of a gravity-driven fraction separator according to a preferred embodiment of the invention. The gravity-driven fraction separator 1 is substantially a substrate 10 having a microchannel structure arranged thereon, in which the microchannel structure is further comprised of: a main channel composed of a first duct 12 and a second duct 13; and a plurality of parallelly aligned manifolds 14*a*, 14*b*; wherein, the plural manifolds are connected to the second duct while each extending longitudinally on the substrate in a manner similar to that of the first duct 12. In a preferred aspect, the substrate 10 is made of Polymethyl Methacrylate (PMMA) of a specific hardness, and the microchannel structure is formed by milling the substrate 10. In addition, the diameter of the cross-section area of the microchannel structure is between 0.1 micrometer and 1000 micrometers, that is dependent upon the micro fluidics flowing therein.

The first duct 12 is extending longitudinally on the substrate following an arrow F2 while sloping with respect to a horizontal level by a specific angle θ, that it is substantially a ditch of L2 length, W2 width and h2 depth. Moreover, a loading well 11, being substantially a circular pit of W1 diameter and hl depth, is arranged at the top of the first duct 12, through which a great amount of micro fluidics can be injected into the microchannel structure and then driven to flow into the first duct 12. In a preferred aspect of the invention, the diameter W1 and the depth h1 of the loading well 11 are all larger than the width W2 and the depth h2 of the first duct 12. In addition, the loading well 11 is channel to an opening 111 for enabling the atmospheric pressure to exert a specific pressure upon the micro fluidics received in the loading well 11 therethrough so as to force the micro fluidic to flow out of the loading well 11 smoothly.

The second duct 13 is connecting to the first duct while extending transversely with respect to the substrate 10 following an arrow F3, that it is substantially a ditch of L3 length, W3 width and h3 depth; whereas the length L3 is different from the length L2 of the first duct 12 while the width W3 and the depth h3 are all equal to the width W2 and the depth h2 of the first duct 12. Moreover, an end of the second duct 13 is connected to the base of the first duct 12 while another end of the second duct 13 is connected to a waste well 18, being substantially a circular pit of W8 diameter and h8 depth. In a preferred aspect of the invention, the diameter W8 and the depth h8 of the waste well 18 are all larger than the width W3 and the depth h3 of the second duct 13, and an expansion angle β8 is constructed by the circular shaped waste well 18 and width W3 of the second duct 13. In the preferred embodiment shown in FIG. 9B, the depth h8 of the waste well 18 is equal to the thickness h of the substrate 10, that the waste well is a hole piecing through the substrate 10 while having an absorbent material 181 arranged therein. It is noted that the absorbent material 181 can be a material selected from the group consisting of a super absorbent fiber, other hydrophilic materials and the combination thereof. In addition, there is at least a plurality of pits 17 formed on the second duct 13, each of which is substantially a circular pit of W7 diameter and h7 depth. As seen in FIG. 9B, by the arrangement of the plural pits, the depth of second duct 13 is varying along the flow of the micro fluidics, moreover, an expansion angle β7 is constructed by the circular shaped pit 17 and width W3 of the second duct 13.

As seen in FIG. 9, the plural manifolds 14*a*, 14*b* are parallelly aligned to each other and connected to the second duct 13 while each extending longitudinally on the substrate 10 in a manner similar to that of the first duct 11 following an arrow F4. In addition, the connecting of the plural manifolds 14*a*, 14*b* is to enable at least a pit 17 to be formed on the second duct 13 at each interval between any two neighboring manifolds 14*a*, 14*b* connecting to the second duct 13. In the embodiment shown in FIG. 9, each of the manifold 14*a* is substantially a ditch of L4*a* length, W4 width and h4 depth; whereas the width W4 is equal to the width W3 of the second duct 13, while the depth h4 is smaller than the depth h3 of the second duct 13. The only difference between the manifold 14*a* and the manifold 14*b* is that the length of the manifold 14*b* is shorter than that of the manifold 14*a*. Therefore, for simplicity, only the manifold 14*a* is used for illustration hereinafter. As seen in FIG. 9, the top of the manifold 14*a* is connected to the second duct 13 while a reservoir 15 is arranged at the base of the manifold 14*a*. The reservoir 15 is substantially a circular pit of W5 diameter and h5 depth. In a preferred aspect of the invention, the diameter W5 and the depth h5 of the waste well 18 are all larger than the width W4 and the depth h4 of the manifold 14*a*, and an expansion angle β5 is constructed by the circular shaped reservoir 15 and width W4 of the manifold 14*a*. In addition, each reservoir 15 has a hole 16 arranged therein whereas the hole 16 pieces through the substrate 10 and connected to an external piping for the micro fluidics to exit the microchannel structure therefrom. It is noted that the diameter of the hole 16 can be any size only if it is small than the diameter W5 of the reservoir 15.

As the aforesaid gravity-driven fraction separator 1 is only designed with respect to the three primary parameters, i.e. microchannel height h, microchannel depth h and expansion angle β, it is desire to place the gravity-driven fraction separator 1 in an inclined position of a specific angle for subjecting the micro fluidics flowing therein to be driven by gravity in actual practice. For achieving so, in a preferred embodiment, an addition structure or apparatus is used for lifting the top portion of the substrate 10 so that the substrate 10 is sloping wile extending longitudinally with respect to the datum water level for enabling the microchannel structure, composed of the first duct 12, the second duct 13 and the plural manifolds 14*a*, 14*b*, to slope respect to the datum water level by a specific angle while extending longitudinally on the substrate 10, and thus the micro fluidics can be driven to flow by gravity from the first duct 12 toward the plural manifolds 14*a*, 14*b*. It is noted that the additional structure or apparatus can be a support platform or a support arm. Moreover, the substrate 10 can be designed with an inclined surface while forming the microchannel structure on the inclined surface, or the depth of the microchannel structure can be varying along the flowing of the micro fluidic, that both are capable of subjecting the micro fluidic flowing therein to gravity. Other then the above-mentioned, there are various means for subjecting the micro fluidic flowing in the microchannel structure to gravity that are known to those skilled in the art and thus are not described further herein. However, for the plate type substrate 10 shown in FIG. 9, an adjustable platform or strut is arranged at the bottom of the substrate for achieving the goal of subjecting the micro fluidic flowing in the microchannel structure to gravity.

From the above description, the micro fluidics is flowing successively passing through the loading well 11, the first duct 12, the second duct 13, the manifolds 14*a*, 14*b* and finally reaching the waste well 18. As the depth, the width and the expansion angle of the microchannel that the micro fluidics is flowing through are changing along the way, it is intended to illustrate the flowing in the figures (a)~(f) of FIG. 10. It is noted that the substrate 10 is sloping wile extending longitudinally with respect to the datum water level for enabling the microchannel structure formed thereon to slope respect to the datum water level by a specific angle while extending longitudinally on the substrate 10, and thus the micro fluidics is driven to flow from the top to the bottom of the substrate 10 while the darkened area of FIG. 10 represents the distribution of the micro fluidics.

Figure 10:
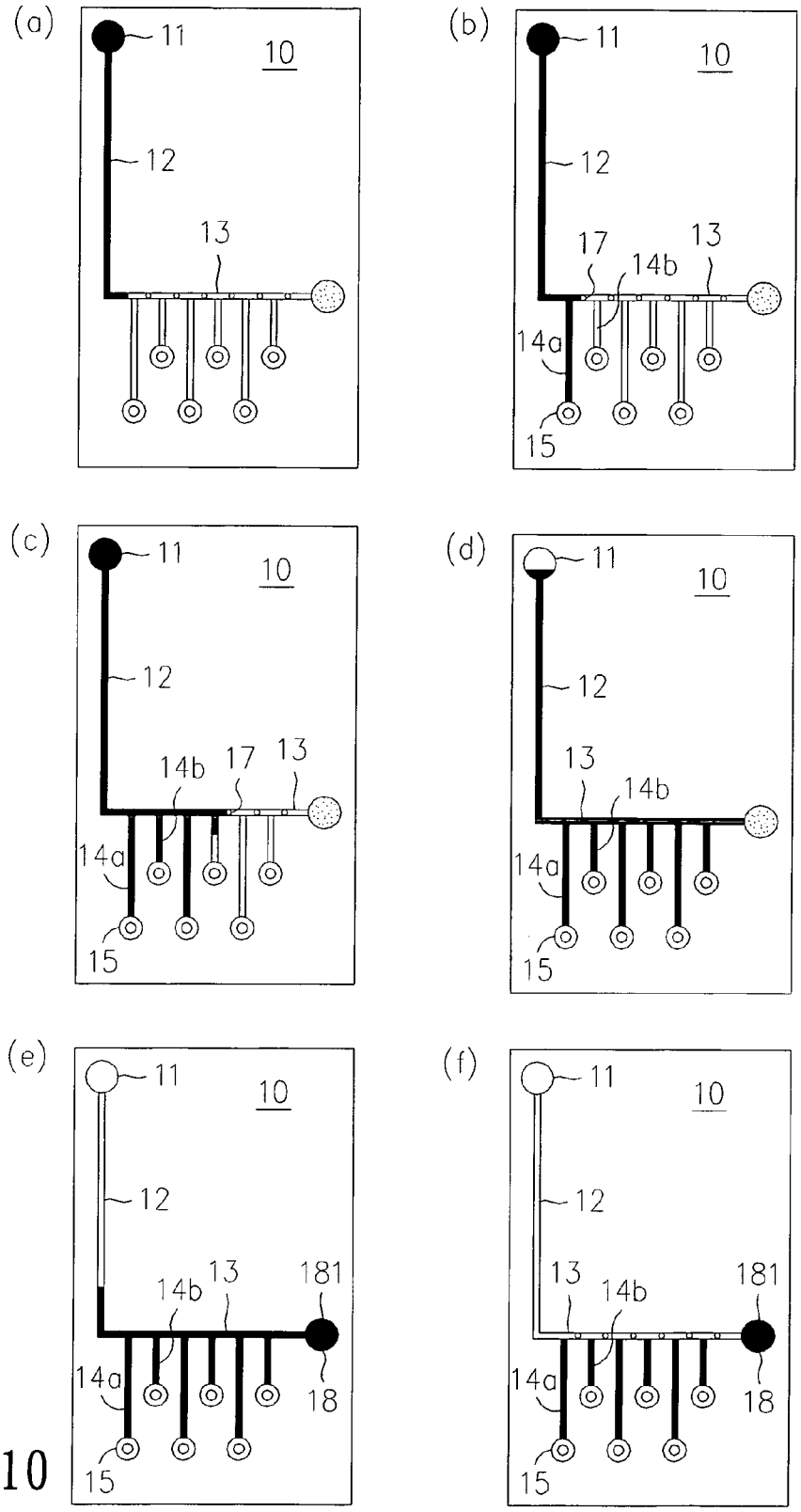
FIG. 10 shows continuous steps of a micro fluidics being split and quantified by a gravity-driven fraction separator of the invention.

In the figure (a) of FIG. 10, as soon as a micro fluidics is injected into the loading well 11, it is driven to flow out of the loading well 11 by the atmospheric pressure of the opening 111 and the gravity and then into the first duct 12 and the second duct successively. Since the width W3 and the depth h3 of the second duct 13 are equal to the width W2 and the depth h2 of the first duct 12, the flowing speed of the micro fluidics remain unchanged while flowing through the first and the second ducts 12, 13.

In the figure (b) of FIG. 10, as the micro fluidics flowing in the second duct 13 reaches the pit 17, the flow of the micro fluidics is stopped by the resistance caused by the depth h7 and the expansion angle β7 of the circular pit 17 that the micro fluidics is forced to flow into the shallower manifold 14*a* of depth h4 as the micro fluidics is keep flowing out of the loading well 11. When the manifold 14*a* and the reservoir 15 thereof is filled, by the resistance caused by the diameter W5 and the depth h5 of the circular reservoir 15 along with the resulting expansion angle β5, the micro fluidics can be stopped from keep flowing into the reservoir 15.

In the figure (c) of FIG. 10, as the resistance of the reservoir 15 is larger than that of the circular pit 17 and the micro fluidics is keep flowing out of the loading well 11, gravity will overcome the resistance of the pit 17 and force the micro fluidics to keep flowing until it reaches the next pit 17 on the second duct 13 where it is stopped again and redirected to flow into the manifold 14*b*. As the flowing of the micro fluidics is similar to that of the manifold 14*a* only the manifold 14*b* is shorter, the description of the flowing in the manifold 14*b* is not described further herein. Thus, the plural manifolds 14*a*, 14*b* are filled successively, as seen in the figure (d) of FIG. 10.

In the figure (d) and figure (e) of FIG. 10, when all the manifolds 14*a*, 14*b* are filled, as the micro fluidics is keep flowing out of the loading well 11 while the flowing is resisted by the resistance caused by the reservoirs 15 and attracted by the absorbent material 181 disposed in the waste well 18, the flowing of the micro fluidics is driven to flow toward the waste well 18 until all the micro fluidics filled in the loading well 11, the first duct 12 and the second duct 13 are all being absorbed by the absorbent material 181. For those micro fluidics filled the manifolds 14*a*, 14*b*, as the depths h4 of the manifolds 14*a*, 14*b* are smaller than the depth h3 of the second duct 13 and the positions of the manifolds 14*a*, 14 b with respect to datum water level is lower than that of the second duct 13, they will not be drained by the absorbent material 181.

In the figure (f) of FIG. 10, when all the micro fluidics, except for those filled in the manifolds 14*a*, 14*b* are all drained by the absorbent material 181, each of the plural manifolds 14*a*, 14*b* will accommodate a specific amount of micro fluidics, in that the amount of the micro fluidics can be changed with the changed of the lengths, widths and depths of the plural manifolds 14*a*, 14*b* so as to match the amount of the micro fluidics with the type of the micro fluidics as well as the posterior tests. In the preferred embodiment shown in FIG. 10, there are three manifolds 14*a* and three manifolds 14*b* so that, for the micro fluidics of two different specific amount, there are three samples in respective. Moreover, each reservoir 15 has a hole 16 arranged therein whereas the hole 16 pieces through the substrate 10 and is connected to an external piping for the micro fluidics to exit the microchannel structure therefrom and into a test tube, collecting bottle, or other devices, to be used for posterior testing.

Form the abovementioned embodiment, it is concluded that the design of the gravity-driven fraction separator 1 of the invention is able to drive the micro fluidics to flow in the microchannel structure successfully and sufficiently, that is, not only the micro fluidics is driven to flow through those channel of low specific resistance, but also it is enabled to filled the whole microchannel structure completely. Therefore, by the accurate definition of the lengths, widths, depths of the plural manifolds, the goal of accurate and automatic quantification/separation of the micro fluidics can be achieved. The function of the last pit 17, that is the closest to the waste well 18, is to provide a resistance to ensure that all the plural manifolds 14*a*, 14*b* are filled by the micro fluidics. Hence, by the absorbing force of the absorbent material 181 disposed in the waste well 18, the excess micro fluidics remained in the first duct 12 and the second duct 13 can be rapidly drained and collected in the waste well 18. During the draining of the excess micro fluidics in the first duct 12 and the second duct 13, by the work of the gravity and the cross-section differences between the manifolds 14*a*, 14*b* and the main channel of the first and the second ducts 12, 13, only the micro fluidics remaining in the first duct 12 and the second duct 13 will be absorbed by the absorbent material 181 while the micro fluidics in the manifolds 14*a*, 14*b* will not be affected, and thus the separation and quantification of the micro fluidics are accomplished. Moreover, on order to optimize the flowing of the micro fluidics, the interior of the microchannel structure can be processed by a hydrophilic/hydrophobic coating. After the separation and quantification of the micro fluidics are accomplished, the separated micro fluidics are drained form different holes 16 through independent pipings so as to be used for various tests.

It is clear that the actual size of the microchannel structure is dependent on the type of the micro fluidics and the required sample amount of the micro fluidics. For the embodiment shown in FIG. 9, FIG. 9A and FIG. 9B, the actual sizes are illustrated in the following table:

| | width (diameter) | depth | length |
|---|---|---|---|
| Loading well 11 | 5.5 mm | 3.0 mm | 5.5 mm |
| First duct 12 | 1.0 mm | 1.0 mm | 48.0 mm |
| Second duct 13 | 1.0 mm | 1.0 mm | 37.0 mm |
| Manifold 14a | 1.0 mm | 0.5 mm | 18.0 mm |
| Reservoir 15 | 3.5 mm | 2.0 mm | 3.5 mm |
| Pit 17 | 1.0 mm | 0.3 mm | 1.0 mm |
| Waste well 18 | 6.0 mm | 5.0 mm | 6.0 mm |

In addtion, by the gravity-driven fraction separator of the invention, a method capable of achieving an accurate quantification and separation of a micro fluidics can be provided, which comprises steps of:

(a) filling the micro fluids into the upstream of a microchannel structure, whereas the microchannel structure is extending while sloping with respect to a datum water level by a specific angle;

(b) enabling the micro fluidics to flow toward the downstream of the microchannel structure as it is driven by gravity; and (c) enabling the micro fluidics to fill a plurality of manifolds, whereas each manifold is formed at the downstream of the microchannel structure and each has a specific length.

To sum up, the present invention is advantageous in that:

(1) It can successfully split and divide a flow of a micro fluidics into several segments.

(2) The volume of each segment of the micro fluidics can be accurately defined and specified.

(3) No movable or active device is required for driving the micro fluidics to flow.

(4) It is easy to connect with any posterior test.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A gravity-driven fraction separator for accomplishing an accurate and automatic quantification/separation of micro-volumes of fluids, comprising:

a substrate; and a microchannel structure, extending on the substrate, further comprising:

at least one main channel, extending on the substrate that slopes with respect to a horizontal level by a specific angle;

at least one loading well, at an upstream of the at least one main channel, for receiving the micro-volumes of fluids and enabling the micro-volumes of fluids to fill into the at least one main channel;

a plurality of manifolds, formed in an area at a downstream of the at least one main channel, each of the manifolds being connected to the at least one main channel;

at least one pit, formed inside on the at least one main channel and between any two immediately adjacent manifolds connecting to the at least one main channel, the at least one pit comprising a circular recess having a diameter equal to or less than that of the at least one main channel; and a plurality of reservoirs, disposed respectively at the ends of the plural manifolds, for receiving the microvolumes of fluids.

2. The gravity-driven fraction separator of claim 1, wherein the depth of the at least one main channel is different from that of each manifold connecting thereto.

3. The gravity-driven fraction separator of claim 1, wherein the lengths of the plural manifolds are different from each other.

4. The gravity-driven fraction separator of claim 1, wherein the plural manifolds are formed parallel to each other.

5. The gravity-driven fraction separator of claim 1, wherein the at least one loading well is channel to an opening through a surface of the substrate.

6. The gravity-driven fraction separator of claim 1, wherein a cross-section area of each reservoir is different from that of the manifold connecting thereto.

7. The gravity-driven fraction separator of claim 1, wherein each of the plural reservoirs comprises a channel through a surface of the substrate.

8. The gravity-driven fraction separator of claim 1, wherein the at least one main channel further comprises: a waste well having an absorbent material disposed therein, and being situated at the downstream end of the at least one main channel.

9. The gravity-driven fraction separator of claim 8, wherein a cross-section area of the waste well is different from that of the main channel connecting thereto.

10. The gravity-driven fraction separator of claim 8, wherein the absorbent material is a material selected from the group consisting of a super absorbent fiber, other hydrophilic materials and the combination thereof.

11. The gravity-driven fraction separator of claim 1, wherein the at least one main channel further comprises:

a first duct, extending on the substrate while sloping with respect to the horizontal level; and a second duct, connecting to the first duct while extending transversely with respect to the first duct, wherein the plural manifolds are connected to the second duct and extend parallel to the first duct.

12. The gravity-driven fraction separator of claim 1, wherein a diameter of a cross-section area of the microchannel structure is between 0.1 micrometer and 1000 micrometers.

13. The gravity-driven fraction separator of claim 1, wherein the interior of the microchannel structure has a hydrophilic/hydrophobic coating.

14. The gravity-driven fraction separator of claim 1, wherein the substrate is made of Polymethyl Methacrylate (PMMA).

* * * * *